United States Patent [19]

Keeney et al.

[11] Patent Number: 4,974,441

[45] Date of Patent: Dec. 4, 1990

[54] DUCTWORK CLIP UNCRIMPER

[76] Inventors: Jeffrey A. Keeney, Rte. 112, Huntington, Mass. 01050; Philip R. Giroux, 213 Glendale Rd., Box 532, Hampden, Mass. 01036

[21] Appl. No.: 412,420

[22] Filed: Sep. 26, 1989

[51] Int. Cl.[5] ..... B21D 5/16

[52] U.S. Cl. ..... 72/458; 72/479; 81/3.55; 29/426.5

[58] Field of Search ..... 72/457, 458, 472, 479; 81/3.55; 29/242, 403.3, 426.5, 426.1

[56] References Cited

U.S. PATENT DOCUMENTS

| | | | |
|---|---|---|---|
| 1,616,653 | 2/1927 | Frasier et al. | 72/458 |
| 2,118,159 | 5/1938 | Castner | 81/3.55 |
| 2,576,000 | 11/1951 | Cowan, Jr. | 81/3.55 |
| 3,050,838 | 8/1962 | Stultz, Jr. | 81/3.55 |
| 3,872,745 | 3/1975 | Garza et al. | 81/3.55 |
| 4,034,595 | 7/1977 | Smith | 72/458 |
| 4,216,685 | 8/1980 | Taylor | 81/3.55 |

*Primary Examiner*—David Jones

*Attorney, Agent, or Firm*—Ross, Ross & Flavin

[57] ABSTRACT

This tool envisions a method for separating clinched together first and second components of a duct, which components have been clinched into interengagement, by the uncrimping of the clinch collar tab of the first component from the second component. The clinched parts are first pried loose by a sharpened point of a tool which is penetrated between the tab and the second component. The prying is continued by virtue of the use of the fulcrum, integral with the tool, so that the tab is moved from its initial 90° dihedral position to its subsequent zero degree dihedral position.

1 Claim, 2 Drawing Sheets

DUCTWORK CLIP UNCRIMPER

BACKGROUND OF THE INVENTION

The present invention is directed toward a hand implement, and more particularly, toward a hand tool for uncrimping clips or lips at abutting edges of components of a duct, which clips are used initially to secure the components together in the formation of the duct.

In the trade, the tool will be known as a clinch collar tab lifter, the folded over clip or lip of a duct being identified as a clinch collar tab and the tool being identified as a tool for lifting the tab or tabs away from clinching position.

As known, ductwork is utilized in many different types of installations for heating, air conditioning, ventilating and like systems and is formed from sheet metal, sections thereof being commonly connected together at the manufacturing facility, but frequently being connected together at the job site. They normally are of square, or rectangular, or circular cross section.

A common form of duct system may include a main run from which extend one or more branches connected to angularly related sections by elbows or the like. Oftentimes, a run will extend over or under a beam or the like or around a projection and, to accomplish this, run sections are connected in offset relation by components such as elbows and various fittings.

The components or certain thereof are usually provided with the clinch collar tabs extending along an edge so that they can be bent or crimped into a clinching relation with a related component, and usually at a sharp angle relative thereto, whereby the components are interconnected to comprise parts of a completed duct.

The clips of a component are usually hammered down or otherwise forced in order to crimp or bend the same relative to its related component.

That is, the clip of the workpiece is initially bent at a substantially right angle in the shape of a 90° dihedral and into contacting and overlying relation with the cooperant workpiece.

And just as those runs of ducts are assembled or installed, so too, they frequently have to be disassembled for purposes of removal or replacement.

The tool hereof may be defined as a hand implement for applying a pulling force in the unbending or uncrimping of the ends of lips of the walls of sheet metal duct components.

The principal object hereof is directed to the provision of a hand tool of the reverse bending type which is designed to engage the end edge or lip portion of a duct section wall and to bend it away from the other duct section wall with which it is cooperant.

That is, the so-called reverse bending tool is for bending a part of a workpiece, initially bent at a substantially right angle in the shape of a 90° dihedral, to a substantially zero degree dihedral in the act of separating or disengaging the duct components.

According to the invention, the tool is for disengaging the lips on the walls of duct sections and is adapted for manual operation on the job. The tool is of small size, is light in weight, does not require securement to a support, and is easily and readily operable in the hands of the workman, on a duct section already installed.

Not only is the tool of such dimensions and weight that it is readily usuable but it is economical in cost so that a workman may have one as a part of his tool kit.

It is generally the aim hereof to facilitate the disengaging of runs and fittings of the components of a duct system where same is being removed or replaced, all with a minimum of labor so as to reduce costs.

DESCRIPTION OF THE PRIOR ART

No prior art method or means for disengaging components, one from another is known unless resort is made to a claw hammer or screwdriver or like tool wherewith the bent over clips may be uncrimped.

SUMMARY OF THE INVENTION

The problem is not so much one of uncrimping the clips as it is one of accessing thereto so that the uncrimping process may be ensued. It is to be appreciated that the work envisioned is normally involved where the ducts are fully installed usually in some ceiling so that it is difficult to reach the duct exteriors. The easier approach, indeed sometimes the only method of approach, is frequently limited to moving the workman's operating hand through the duct interiors to the area in question.

That is, space limitations which were of primary consideration when the ducts were first fabricated and then installed, present corresponding problems when it comes to uncrimping the pieces from each other in order to permit duct removal or rearrangement.

The tool may be identified as a pry bar wedge member adapted for facilitating the uncrimping of crimped edges of components of a sheet metal duct. It comprises an elongated body member having a wedge shaped head portion at one terminus as means for forcing the separation of a pair of interengaged components of the duct. The body member is rotatable about an axis extending generally parallel to the longitudinal axis of the body member whereby a leverage force can be applied to the body member to cause the wedge member to rotate about the longitudinal axis in the operation of prying one component loose from the attached component in the restricted space environment.

BRIEF DESCRIPTION OF THE DRAWINGS

To enable others skilled in the art so fully to comprehend the underlying features hereof that they may embody the same in the way contemplated by this invention, drawings depicting a preferred typical construction in concrete form have been annexed as part of this disclosure, and in such drawings, like characters of reference denote corresponding parts through all the views, of which.

THE DETAILED DESCRIPTION

Figure 1:
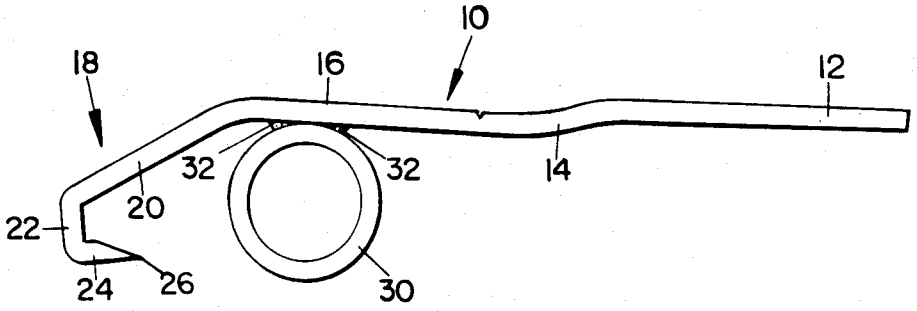
FIG. 1 is a view, in side elevation, of the tool of the invention.
Figure 2:
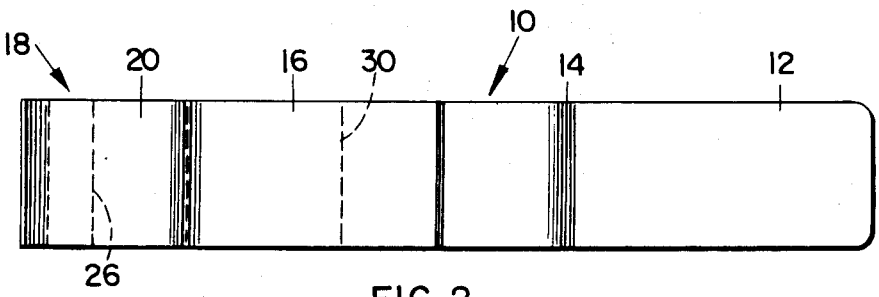
FIG. 2 is a view, in top plan, of the FIG. 1 tool.
Figure 3:
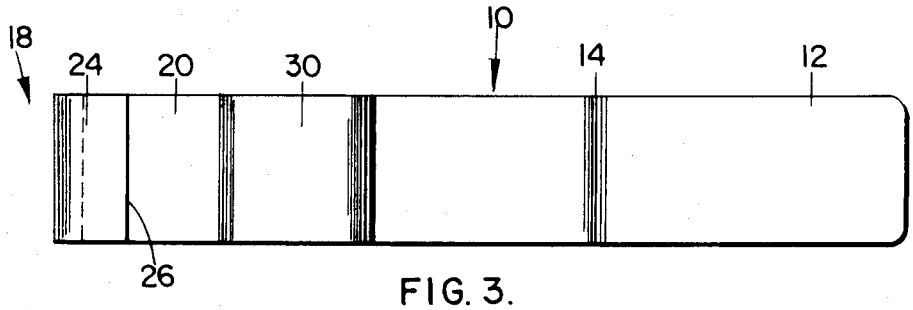
FIG. 3 is a view, in bottom plan, of the FIG. 1 tool.

With continued reference now to the drawings, I have shown a preferred embodiment of the apparatus, constructed in accordance with the teachings hereof in order that its general utility may be better understood.

It will be seen that the device comprises a hand tool for applying to the bent over or crimpd marginal edge of the component of a metallic duct a reverse bend wherefor it may be disengaged from a cooperant component of the duct to which it has been operationally related.

The so-called "clips" of a first embodiment A are represented by the letter B same being one of such clips or bent over edge of the first component into an osculating position relative to a second component C, wherefor components A and C are interengaged and held secure as to each other preparatory to the formation of a completed duct. First component A is formed with a shelf D for supporting second component B.

The entirety of such a duct is not believed to be necessary to be shown, it being well known and understood.

The tool 10 is comprised essentially of a rigid flat substantially planar and elongated base which is preferably comprised of steel or similar material. In the preferred embodiment, the base is approximately six inches long and one inch wide, and has a thickness of approximately one-fourth inch.

The handle end 12 of the tool is represented at its rightward end in all views herein.

At the approximate midsection of the tool, a slight offset 14 is provided so that handle end 12 is disposed in a slightly higher plane than is a rearward portion 16 of the operating end of the tool, that is, sections 12 and 16 are disposed in parallel planes.

The forward portion of the operating end is generally represented by numeral 18 and comprises a first section 20 disposed angularly to rearward portion 16 with which it is, of course, integral, a shorter second section 22 disposed further angularly and extending outboard of and from section 22 but in a rearwardly facing direction.

The terminal end of a third section 24 is provided with a sharp taper 26 to allow the penetration of the tool between coacting duct components as will appear.

Mounted on the underside of rearward portion 16 is a separate fulcrum 30 of tubular configuration, same being secured to rearward portion 16 as by weldments 32.

The tool is normally utilized, when necessary to disengage component parts of a duct, and particularly, when ready access to the area of the desired disengagement is not convenient. Access to such area may be only when and as the workman can extend his hand and arm through the duct interior so as to reach the clinch collar tabs.

The hand tool is used for interrupting the clinching engagement of one duct component with another component to which it has been secured as by the bending over or crimping of the said one edge over the adjacent edge of the related piece of duct.

The securing together of the components of a duct via the clinch collar tab principle is a well known and accepted technique.

Fulcrum 30 is easily maneuverable into a working position so as to allow a means for pivoting the tool. It offers a radius of curvature so as to provide a rolling fulcrum during the initial engaging or loosening operation and the subsequent unbending operation.

As the distance from the tip of taper 26 and fulcrum 30 is short, a good leverage is obtained for unbending the lip.

Figure 4:
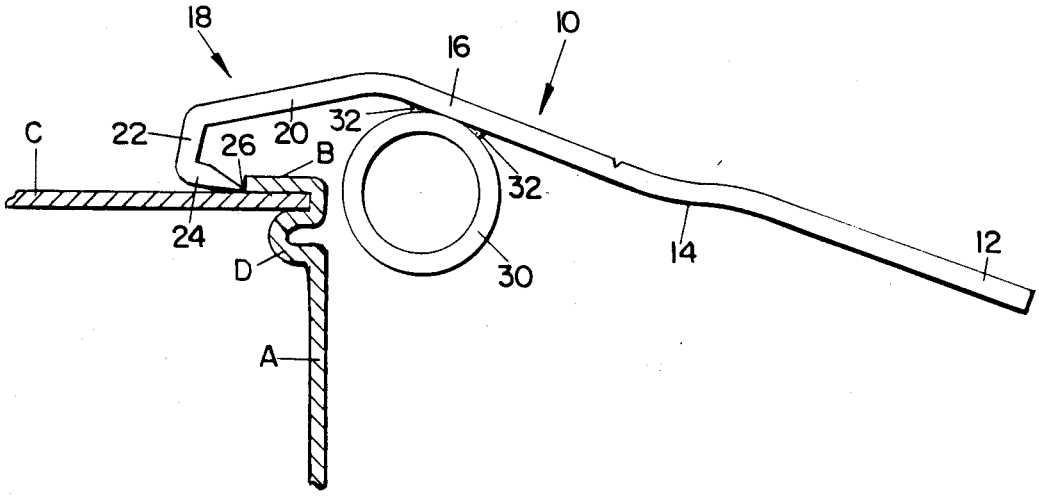
FIG. 4 is a small scale view, of the FIG. 1 tool in a first operational position.
Figure 6:
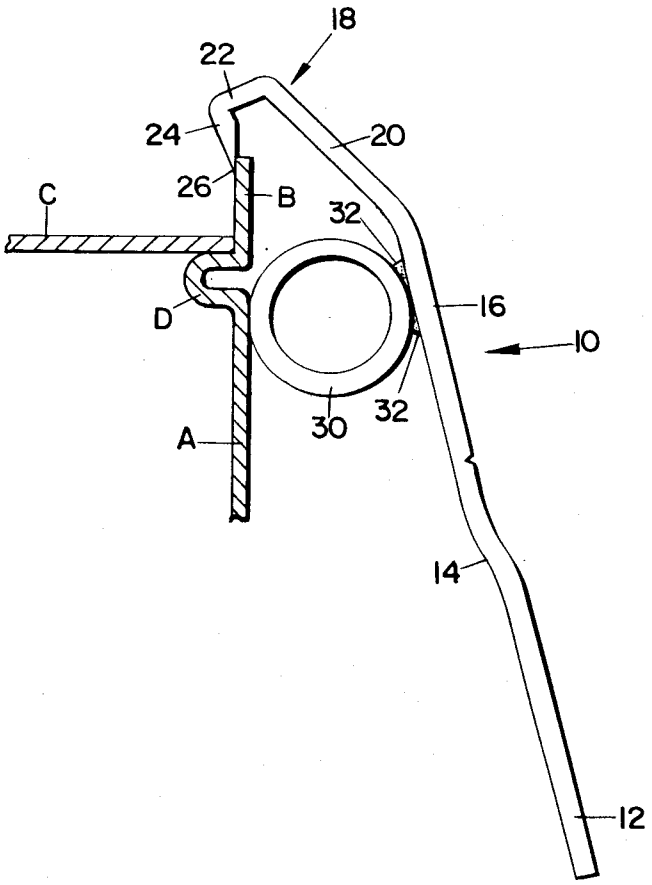
FIG. 6 is a small scale view, of the FIG. 1 tool, in a third operational position.
Figure 5:
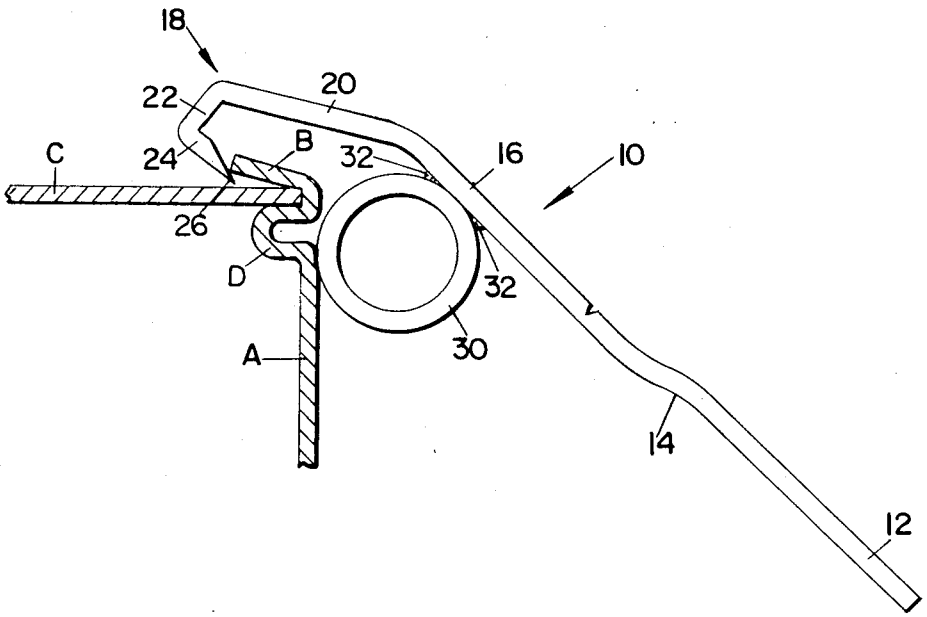
FIG. 5 is a small scale view, of the FIG. 1 tool, in a second operational position.

The reverse bending procedure is illustrated in the series of FIGS. 4, 5 and 6. There it will be seen that clinch collar tab B of workpiece A is initially bent at a substantially right angle in the shape of a 90° dihedral.

The tool is first engaged with the outboard terminus of tab B so as to be penetrable between the clinching position of tab B and component C. The sharpened extremity 26 of the tool permits this initial penetrating or loosening procedure.

Thus loosened, the tool is brought into its second position whereat fulcrum 30 is brought to bear against component A—see FIG. 5—for a rolling contact therewith as the handle is brought downwardly toward the duct—see FIG. 6—wherefor the tab is brought into a position a substantially zero degree dihedral so that the components may thus be successfully separated.

While the invention has been described by means of a specific example and in a specific embodiment, we do not wish to be limited thereto, for obvious modifications will occur to those skilled in the art without departing from the spirit and scope of the invention.

We claim:

1. In a clinch collar tab lifter for use with interengaged first and second components of a duct with the first component having a folded-over clinch collar tab positionable in overlapping coplanar crimped position over an adjacent surface of the second component, the lifter having use in uncrimping the fold-over clinch collar tab of the first component away from its crimping position relative to the second component and comprising: a rigid elongated bar having:

(a) a primary intermediate portion disposed between a rearward manually-engageable terminus constituting a handle and a forward work-engaging terminus constituting an operator, (b) a secondary intermediate portion in the form of a relatively short extension of the primary intermediate portion and extending forwardly and integrally therefrom at an obtuse angle relative thereto, (c) the operator being L-shaped in cross section and integral with the secondary intermediate portion and having one leg depending downwardly therefrom and another leg right angular thereto and terminating in a rearwardly-facing thin tapered free edge, a cylindrical fulcrum welded to the bar at the underside thereof intermediate the manually-engageable and operating termini, the free edge of the operator being adapted for engagement between the clinch collar tab of the first component and the adjacent surface of the second component for effecting a penetration therebetween and the unbending of the tab from initial coplanar position to a subsequent position at a dihedral angel relative to the second component with the fulcrum functioning as a fulcrum point in applying a torque as the manually-engageable terminus is rotated toward the operating terminus.

* * * * *